US006893336B2

(12) United States Patent
Jin

(10) Patent No.: US 6,893,336 B2
(45) Date of Patent: May 17, 2005

(54) POLISHING PAD CONDITIONER AND CHEMICAL-MECHANICAL POLISHING APPARATUS HAVING THE SAME

(75) Inventor: Yang-Woo Jin, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 118 days.

(21) Appl. No.: 10/448,296

(22) Filed: May 30, 2003

(65) Prior Publication Data

US 2004/0018807 A1 Jan. 29, 2004

(30) Foreign Application Priority Data

Jul. 9, 2002 (KR) ..... 2002-39815

(51) Int. Cl.[7] ..... B24B 21/18

(52) U.S. Cl. ..... 451/443; 451/41; 451/56; 451/60; 451/285; 451/286; 451/287; 451/288; 451/443; 451/444; 451/446

(58) Field of Search ..... 461/41, 56, 60, 461/285, 286, 287, 288, 443, 444, 446

(56) References Cited

U.S. PATENT DOCUMENTS 5,626,509 A * 5/1997 Hayashi ..... 451/285
5,951,373 A * 9/1999 Shendon et al. ..... 451/41
6,293,853 B1 * 9/2001 Perlov et al. ..... 451/56
6,325,709 B1 12/2001 Nanda et al.

* cited by examiner

*Primary Examiner*—Joseph J. Hail, III
*Assistant Examiner*—Shantese McDonald
(74) *Attorney, Agent, or Firm*—Volentine Francos, PLLC

(57) ABSTRACT

A polishing pad conditioner for a chemical-mechanical polishing apparatus includes a conditioning plate having a first recess and a holder having a second recess. The first recess is formed on the upper face of the conditioning plate, and the second recess is formed on the bottom face of the holder. A first filling member having a specific gravity smaller than that of the conditioning plate fills up the first recess, and a second filling member having a specific gravity smaller than that of the holder fills up the second recess. Therefore, the weight of the polishing pad conditioner can be reduced, and the durability and service life of an air bladder that adjusts the height of the polishing pad conditioner can be improved.

25 Claims, 6 Drawing Sheets

POLISHING PAD CONDITIONER AND CHEMICAL-MECHANICAL POLISHING APPARATUS HAVING THE SAME

A claim of priority is made to Korean Application 2002-39815 filed on Jul. 9, 2002, which is hereby incorporated by reference in its entirety for all purposes.

BACKGROUND OF THE INVENTION

1. Field of the Invention

The present invention relates to a polishing pad conditioner and a chemical-mechanical polishing (CMP) apparatus, and more particularly to a polishing pad conditioner of a CMP apparatus for chemically and mechanically polishing a semiconductor substrate.

2. Description of the Related Art

Recently, in order to satisfy various requirements of consumers, semiconductor device fabrication technologies have been developed with the trend of improving degree of integration, reliability and response speed. Generally, the semiconductor device is manufactured by repeatedly performing a series of unit processes, such as film deposition process, photolithography process, etching process, ion implanting process, polishing process, cleaning process and drying process, on a semiconductor wafer. In those unit processes, the polishing process has been noticed as one of the main processes of the semiconductor manufacturing technology because it can enhance the integration degree of the semiconductor device and the structural and electrical reliability of the semiconductor device. Currently, a chemical-mechanical polishing (CMP) process is mainly employed because a semiconductor substrate can be planarized through the chemical reaction between a slurry and the film on the semiconductor, and the mechanical friction force between a polishing pad and the film on the semiconductor.

The CMP apparatus generally has a polishing pad attached to a rotating table, a polishing head that holds a semiconductor substrate and rotates the semiconductor substrate, a slurry supplying part that supplies a slurry between the polishing pad and the semiconductor substrate, and a polishing pad conditioner that improves the surface condition of the polishing pad. Additionally, a polishing end point detecting device is installed in the CMP apparatus for determining the polishing end point of the CMP process.

The slurry serves as a medium for transferring abrasive particles and chemicals from the surface of the semiconductor substrate to be polished and to the surface of the semiconductor substrate to be polished. As for the CMP process using the slurry, the polishing rate of the semiconductor substrate becomes the main parameter of the CMP process, and the polishing rate is greatly dependent on the slurry employed during the CMP process. The abrasive particles included in the slurry generally have the diameter of approximately 10 to 1,000 Å, and the abrasive particles have a hardness substantially identical to that of the semiconductor substrate, in order to accomplish the mechanical polishing.

A plurality of grooves are concentrically formed on the surface of the polishing pad attached on the rotating table in order to uniformly supply the slurry to the surface of the polishing pad, and also minute holes for receiving the slurry are formed on the surface of the polishing pad. Types of polishing pads include soft pads and hard pads. The soft pad is usually a felt pad including urethane, and the hard pad is usually a porous urethane pad.

When the semiconductor substrate is chemically and mechanically polished with the above-mentioned polishing pad and the slurry, the minute holes may be choked with polished by-products generated during the polishing process. Thus, a pad conditioning process should be simultaneously executed with the polishing process in order to perforate the minute holes choked with the polished by-products.

A polishing pad conditioner for performing a pad conditioning process is illustratively disclosed in U.S. Pat. No. 6,325,709 (issued to Nanda et al.). The polishing pad conditioner makes contact with a polishing pad, and diamond particles are attached to the convex bottom face of the polishing pad conditioner through a nickel-plating process.

In general, a conventional polishing pad conditioner includes a conditioning disc and a disc holder. Diamond particles are attached to the bottom face of the conditioning disc that contacts the polishing pad using a bonding agent or by an electroplating process. The disc holder holds the conditioning disc by a magnetic force. However, the conditioning disc may slide from the disc holder during the polishing pad conditioning process. Such a problem can be solved by combining the conditioning disc with the disc holder using bolts.

FIG. 1 is a schematic cross-sectional view illustrating a conventional polishing pad conditioner 100. Referring to FIG. 1, diamond particles 112 are attached to the bottom face of the conditioning disc 110 using an adhesive or by an electroplating process, and a plurality of screw holes are formed at the peripheral portion of the upper face of the conditioning disc 110.

The disc holder 120 has a disc shape with a diameter identical to that of the conditioning disc 110, and a plurality of penetration holes are formed at the edge peripheral portion of the disc holder 120. The bolts 130 pass through the penetration holes of the disc holder 120, and are inserted into the screw holes of the conditioning disc 110 so that the bolts 130 combine the conditioning disc 110 with the disc holder 120. The penetration holes of the disc holder 120 have stepped portions from the upper face of the disc holder 120 in order to receive the heads of the bolts.

A rotation shaft 140 is connected to the central portion of the upper face of the disc holder 120 for transmitting a rotation force, and an air bladder 150 is installed at the central portion of the rotation shaft 140 for upwardly and downwardly moving the conditioning disc 110 and the disc holder 120. A space 152 is provided in the air bladder 150 for receiving air, and the volume of the air bladder 150 is controlled in accordance with the pressure of the air received in the space 152. The conditioning disc 110 and the disc holder 120 upwardly or downwardly move according to the expansion and the contraction of the air bladder 150 due to the variation of the pressure therein.

However, the polishing pad conditioner 100 including the bolts 130 is heavier than the polishing pad conditioner that utilizes a magnetic force to hold a conditioning disc. In fact, the weight of the conditioning disc and the disc holder of the polishing pad conditioner utilizing the magnetic force are approximately 285 g and 160 g, respectively. On the other hand, the weight of the conditioning disc 110 and the disc holder 120 of the polishing pad conditioner 100 including the bolts 130 are approximately 430 g and 360 g, respectively.

Accordingly, it is difficult to control the upward and the downward motions of the heavy polishing pad conditioner 100. That is, the volume of the air bladder 150 may be difficult to control because of the heavy polishing pad conditioner 100. For example, if the air bladder 150 is exceedingly expanded, the conditioning disc 110 is too tightly contacted with the polishing pad so that the polishing pad may be damaged. On the other hand, the conditioning disc 110 does not make contact with the polishing pad if the air bladder 150 is not normally expanded. In addition, the durability and service life of the air bladder 150 may be deteriorated because of the heavy polishing pad conditioner 100.

As it is described above, when the polishing pad conditioner 100 does not normally move in the upward and the downward directions, the polishing process may not be exactly performed on the semiconductor substrate because the surface condition of the polishing pad is not improved.

SUMMARY OF THE INVENTION

The present invention is therefore directed to a polishing pad conditioner and a chemical-mechanical polishing apparatus which substantially overcome one or more of the problems due to the limitations and disadvantages of the related art.

In order to overcome above-mentioned problems, it is a first object of the present invention to provide a polishing pad conditioner having reduced weight.

It is a second object of the present invention to provide a chemical-mechanical polishing apparatus including a polishing pad conditioner having reduced weight.

In order to achieve the above first and other objects, the present invention provides a polishing pad conditioner including a conditioning plate making contact with a pad for improving a surface condition of the pad that polishes a surface of a substrate, the conditioning plate having a first face and a second face with a first recess formed thereon, the first face making contact with the pad; a holder coupled to the second face of the conditioning plate, the holder having a third face wherein a second recess is formed on the third face; and a combining member for combining the conditioning plate with the holder.

Also, to achieve the above first and other objects of the present invention, there is provided a polishing pad conditioner including a conditioning plate for improving a surface condition of a pad that polishes a surface of a substrate, the conditioning plate having a first face making contact with the pad and a second face corresponding to the first face wherein a first recess is formed on the second face; a holder coupled to the second face of the conditioning plate, the holder having a third face making contact with the second face wherein a second recess corresponding to the first recess is formed on the third face; a first filling member filling up the first recess wherein the first filling member includes a first material having a specific gravity smaller than that of the conditioning plate; a second filling member filling up the second recess wherein the second filling member includes a second material having a specific gravity smaller than that of the holder; and a combining member for combining the conditioning plate with the holder.

To achieve the above second and other objects of the present invention, there is provided a chemical-mechanical polishing apparatus including a rotating table having a pad for polishing a surface of a substrate; a polishing head for holding the substrate so that the surface of the substrate to be polished is opposed to the pad, for contacting the surface of the substrate with the pad during polishing of the substrate, and for rotating the substrate; a slurry supplying part for supplying a slurry between the substrate and the pad during polishing of the substrate; and a polishing pad conditioner having i) a conditioning plate for improving a surface condition of the pad, the conditioning plate having a first face making contact with the pad and a second face corresponding to the first face wherein a first recess is formed on the second face, ii) a holder coupled to the second face of the conditioning plate, the holder having a third face wherein a second recess corresponding to the first recess is formed on the third face, and iii) a combining element for combining the conditioning plate with the holder.

According to the present invention, the weight of the polishing pad conditioner can be reduced in accordance with the volumes of the first and the second recesses, and the specific gravities of the first and the second filling members. Hence, the volume of an air bladder can be easily controlled for upwardly and downwardly moving the polishing pad conditioner, and the operation of the polishing pad conditioner can be stably accomplished.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, the preferred embodiments of the present invention will be described in detail with reference to the accompanying drawings.

Figure 2:
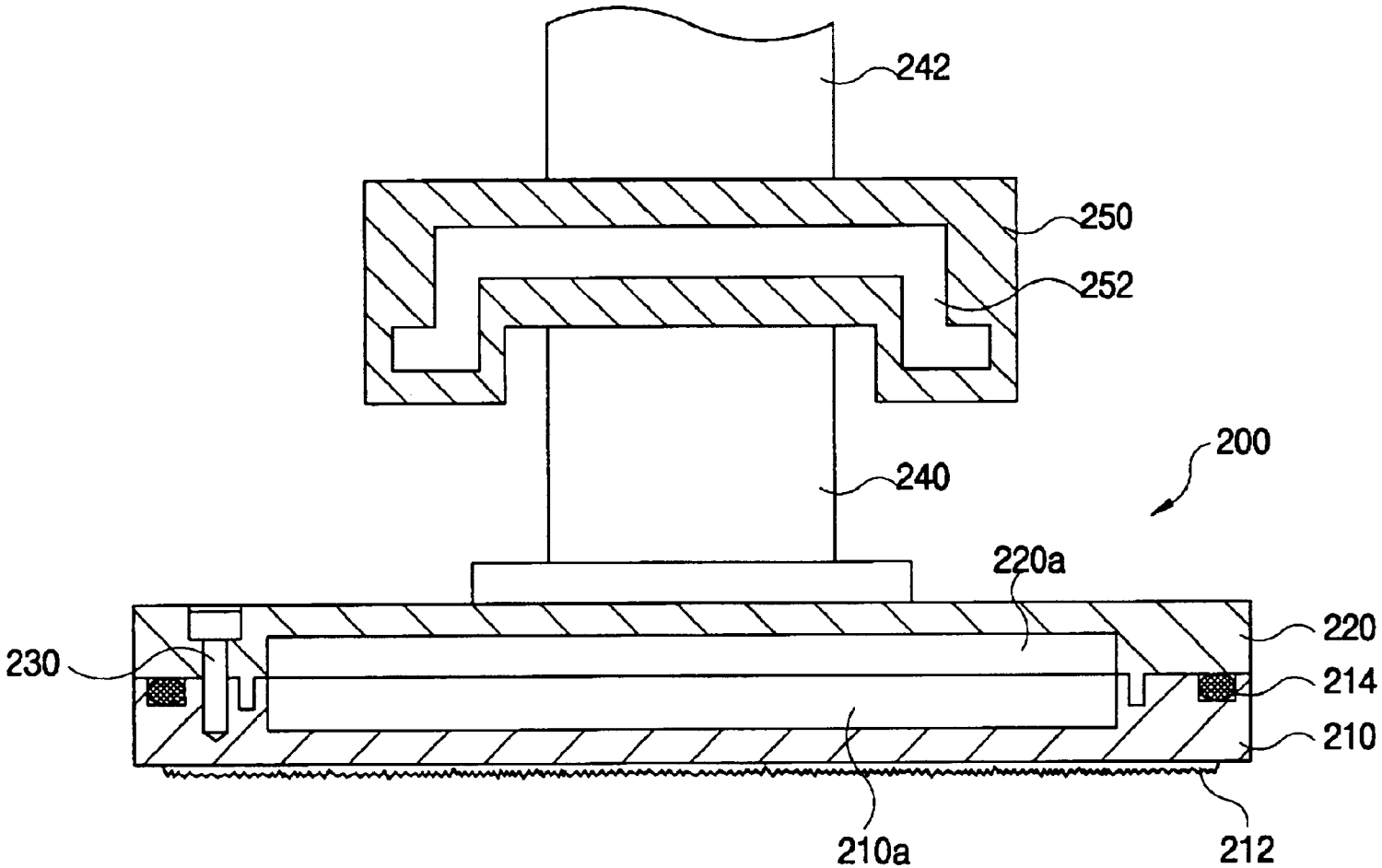
FIG. 2 is a schematic cross-sectional view illustrating a polishing pad conditioner according to a first embodiment of the present invention.
Figure 3:
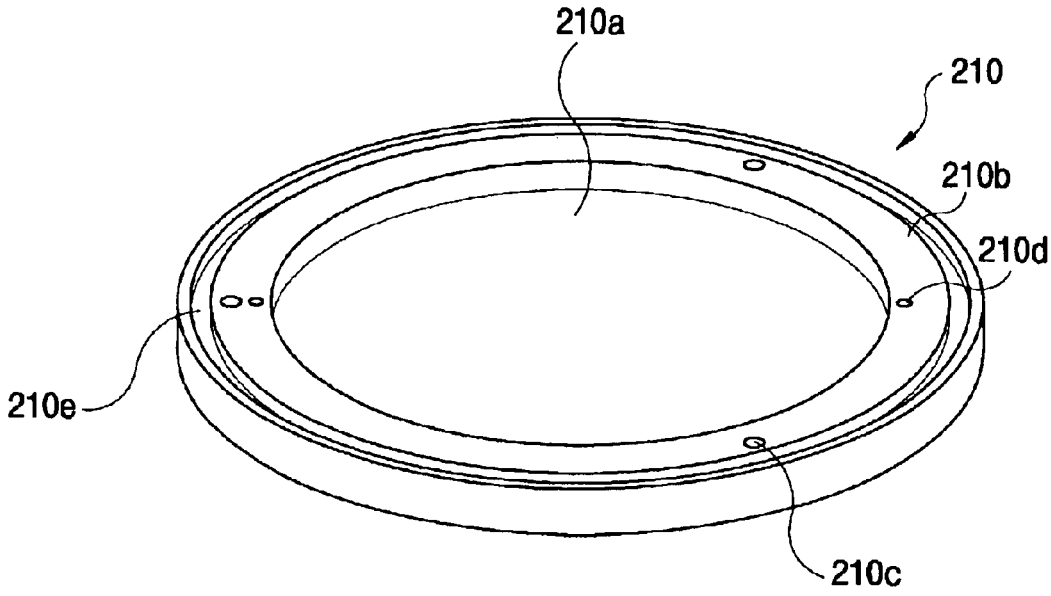
FIG. 3 is an enlarged perspective view showing a conditioning plate as shown in FIG. 2.
Figure 4:
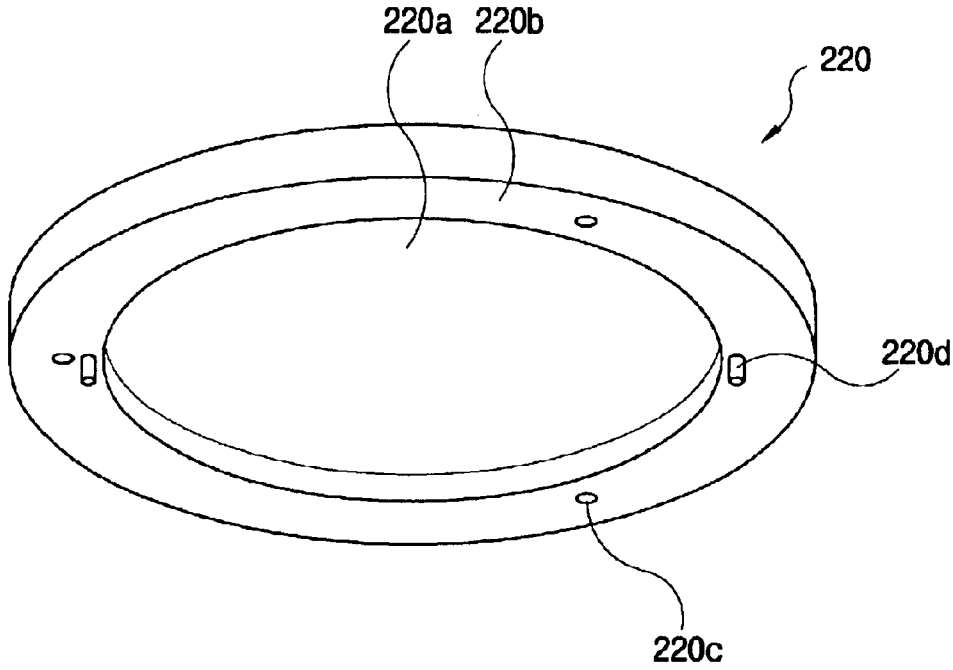
FIG. 4 is an enlarged perspective view showing a holder as shown in FIG. 2.

FIG. 2 is a schematic cross-sectional view illustrating a polishing pad conditioner according to a first embodiment of the present invention, FIG. 3 is an enlarged perspective view showing a conditioning plate in FIG. 2, and FIG. 4 is an enlarged perspective view showing a holder in FIG. 2.

Referring to FIGS. 2 to 4, a polishing pad conditioner 200 has a conditioning plate 210, a holder 220, and a plurality of bolts 230. The conditioning plate 210 improves the surface condition of a polishing pad that polishes the surface of a semiconductor substrate. The holder 220 holds the conditioning plate 210, and the bolts 230 combine and secure the conditioning plate 210 with the holder 220.

The conditioning plate 210 has a disc shape, and the holder 220 also has a disc shape corresponding to that of the conditioning plate 210. A first recess 210*a* is formed on the upper face of the conditioning plate 210 adjacent to the holder 220 in order to reduce the weight of the conditioning plate 210. In addition, a second recess 220*a* is formed on the bottom face of the holder 220 adjacent to the conditioning plate 210, so as to reduce the weight of the holder 220. The first recess 210*a* having a circular shape is formed at the central portion of the upper face of the conditioning plate 210, not at the edge portion 210*b* of the upper face of the conditioning plate 210, as particularly shown in FIG. 3. The second recess 220*a* corresponds to the first recess 210*a*, and has a diameter nearly identical to that of the first recess 210*a*. The second recess 220*a* having a circular shape is formed at the central portion of the bottom face of the holder 220, not at the edge portion 220*b* of the bottom face of the holder 220, as particularly shown in FIG. 4.

A plurality of screw holes 210*c* are formed at the edge portion 210*b* of the upper face of the conditioning plate 210, and a plurality of penetration holes 220*c* are formed at the edge portion 220*b* of the bottom face of the holder 220. The penetration holes 220*c* correspond to the screw holes 210c, respectively.

The bolts 230 for combining the conditioning plate 210 with the holder 220 are inserted into the screw holes 210*c* of the conditioning plate 210 through the penetration holes 220*c* of the holder 220. The penetration holes 220*c* of the holder 220 have stepped portions formed therein from the upper face of the holder 220, in order to insert the heads of the bolts 230 into the penetration holes 220*c*.

A plurality of fixing grooves 210*d* are formed at the edge portion 210*b* of the upper face of the conditioning plate 210, so as to fix the combined position of the conditioning plate 210 and the holder 220. A plurality of fixing pins 220*d* is provided at the edge portion 220*b* of the bottom face of the holder 220. The fixing pins 220*d* correspond to the fixing grooves 210*d*, respectively.

Diamond particles 212 are attached to the bottom face of the conditioning plate 210 by an electroplating process. The diamond particles 212 make contact with the polishing pad, and improve the surface condition of the polishing pad in accordance with the rotations of the conditioner 200 and the polishing pad. That is, the surface of the polishing pad is minutely cut by the diamond particles 212, and the polished by-products stopping up minute holes formed in the polishing pad are removed by the diamond particles 212. In this case, the diamond particles 212 may be attached to the bottom face of the conditioning plate 210 using an adhesive including resin or a bonding agent including metal.

A sealing member 214 is disposed at the edge portion 210*b* of the upper face of the conditioning plate 210. The sealing member 214 prevents the slurry for chemically and mechanically polishing the semiconductor substrate and the rinsing solution for rinsing the polishing pad from flowing into the first recess 210*a* of the conditioning plate 210 and the second recess 220*a* of the holder 220. The sealing member 214 can include an O-ring or packings having various shapes.

A groove 210*e* is provided at the edge portion 210*b* of the upper face of the conditioning plate 210 in order to receive the sealing member 214. The groove 210*e* of the conditioning plate 210 has an annular ring shape, and also has a central point identical to that of the conditioning plate 210. The screw holes 210*c* and the fixing holes 210*d* of the conditioning plate 210 are disposed along the inside of the groove 210*e*.

A first rotating shaft 240 is connected at the central portion of the upper face of the holder 220 in order to transfer a rotation force, and an air bladder 250 is mounted on the first rotating shaft 240 so as to move the polishing pad conditioner 200 in the upward and downward directions. A second rotating shaft 242 is connected to the air bladder 250 for transferring the rotation force.

The air bladder 250 includes a material having elasticity such as rubber, and a space 252 is provided in the air bladder 250 for receiving air. The volume of the air bladder 250 is varied in accordance with the inner pressure thereof, and the polishing pad conditioner 200 upwardly or downwardly moves according to the variation of the volume of the air bladder 250.

Figure 1:
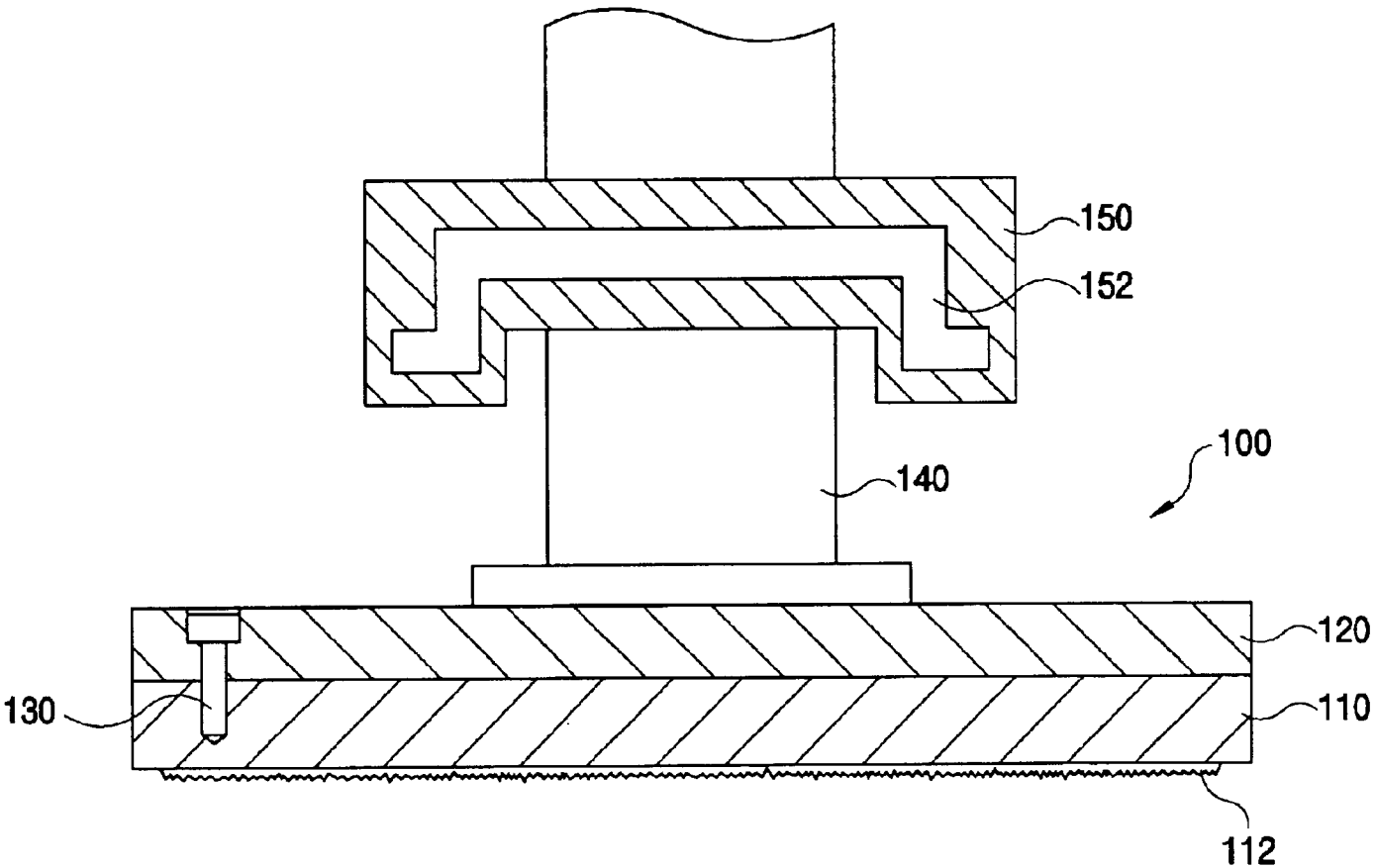
FIG. 1 (PRIOR ART)
FIG. 1 is a schematic cross-sectional view illustrating a conventional polishing pad conditioner.

The weight of the polishing pad conditioner 200 as compared to that of the conventional polishing pad conditioner of FIG. 1 is decreased because of the volumes of the first recess 210*a* of the conditioning plate 210 and the second recess 220*a* of the holder 220. As the weight of the polishing pad conditioner 200 is reduced by the weight corresponding to the volume of the first recess 210*a* and the second recess 220*a*, the upward and the downward control of movement of the polishing pad conditioner 200 can be easily accomplished. That is, the inner pressure of the air bladder 250 can be easily controlled with the polishing pad conditioner 200 having reduced weight, and also the position response of the polishing pad conditioner 200 dependent on the volume variation of the air bladder 250 can be improved. Additionally, the durability and service life of the air bladder 250 can be increased in accordance with the weight reduction of the polishing pad conditioner 200.

Figure 5:
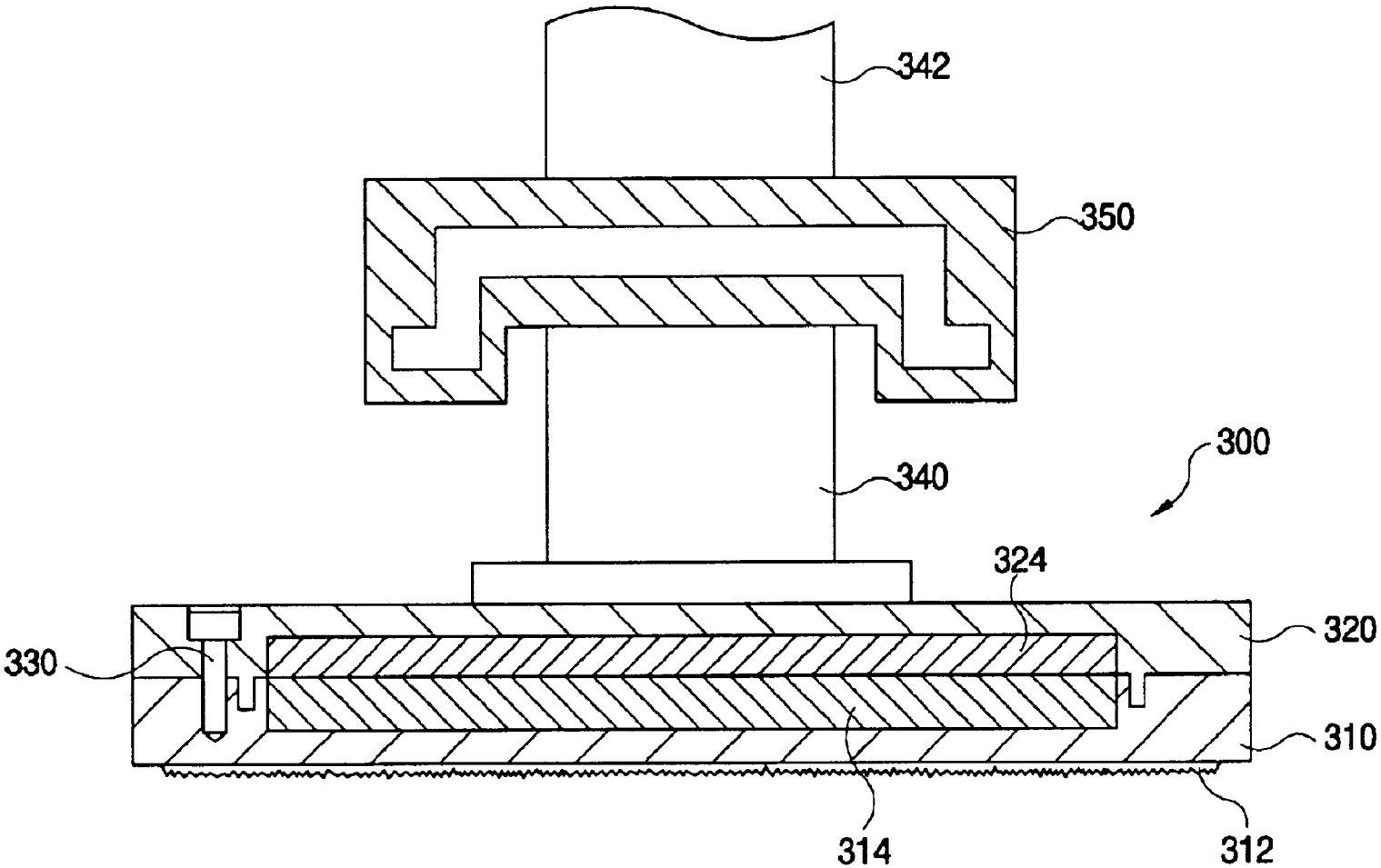
FIG. 5 is a schematic cross-sectional view illustrating a polishing pad conditioner according to a second embodiment of the present invention.

FIG. 5 is a schematic cross-sectional view illustrating a polishing pad conditioner according to a second embodiment of the present invention. Referring to FIG. 5, a polishing pad conditioner 300 of the present embodiment has a conditioning plate 310 and a holder 320. The conditioning plate 310 has a disc shape, and the holder 320 also has a disc shape corresponding to that of the conditioning plate 310. A first recess is formed on the upper face of the conditioning plate 310, and a second recess corresponding to the first recess is provided on the bottom face of the holder 320. The conditioning plate 310 combines with the holder 320 using a plurality of bolts 330. In this second embodiment, the shapes and features of the conditioning plate 310 and the holder 320 are identical to those of the polishing pad conditioner 200 of the first embodiment, so that further detailed description of the conditioning plate 310 and the holder 320 will be omitted.

The polishing pad conditioner 300 of the present embodiment includes a first filling member 314 and a second filling member 324. The first filling member 314 fills up the first recess of the conditioning plate 310, and the second filling member 324 fills up the second recess of the holder 320. The first and the second filling members 314 and 324 prevent the slurry for chemically and mechanically polishing the semiconductor substrate and the rinsing solution for rinsing the polishing pad from flowing into the space defined by the first and the second recesses. The first and the second filling members 314 and 324 may include material having specific gravity lower than that of the conditioning plate 310 and the holder 320. When the conditioning plate 310 and the holder 320 include a metal such as stainless steel, the first and the second filling members 314 and 324 may include synthetic resin, respectively. The first and the second filling members 314 and 324 including synthetic resin can reduce the weight of the polishing pad conditioner 300.

Although a sealing member is not shown in FIG. 5, a sealing member can be disposed at the edge portion of the upper face of the conditioning plate 310 in order to prevent the slurry for chemically and mechanically polishing the semiconductor substrate and the rinsing solution for rinsing the polishing pad from flowing into the polishing pad conditioner 300.

A first rotating shaft 340 is coupled to the central portion of the upper face of the holder 320 in order to transfer a rotation force, and an air bladder 350 is installed on the first rotating shaft 340 so as to move the polishing pad conditioner 300 in the upward and the downward directions. A second rotating shaft 342 is connected to the air bladder 350 for transferring the rotation force.

The weight of the polishing pad conditioner 300 as compared to that of the conventional polishing pad conditioner of FIG. 1 is decreased because the volumes of the first and the second recesses, and the specific gravities of the first and the second filling members 314 and 324. Because the weight of the polishing pad conditioner 300 is reduced due to the first and the second recesses, and the first and the second filling members 314 and 324, the volume of the air bladder 350 can be easily controlled, and the life time of the air bladder 350 can be improved.

Figure 6:
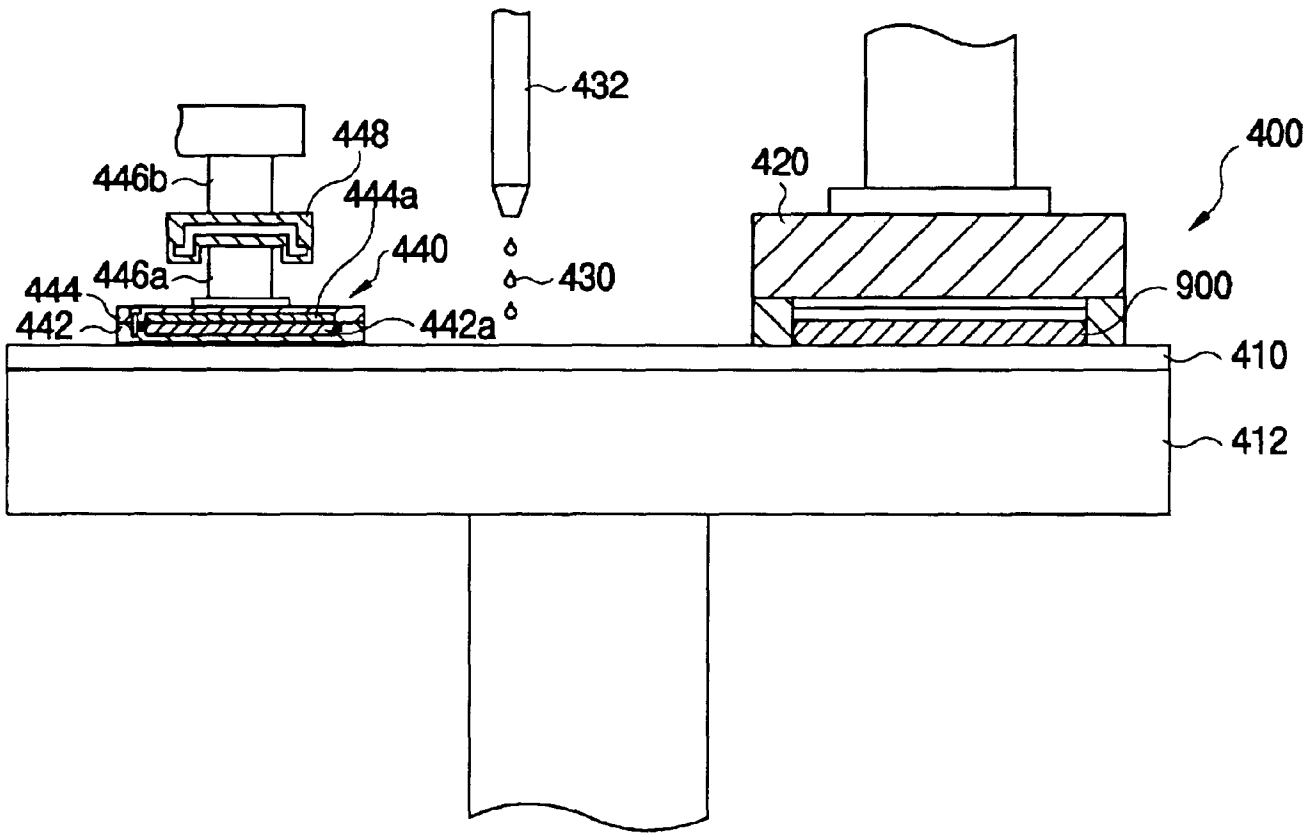
FIG. 6 is a schematic cross-sectional view illustrating a chemical-mechanical polishing (CMP) apparatus according to a third embodiment of the present invention.
Figure 7:
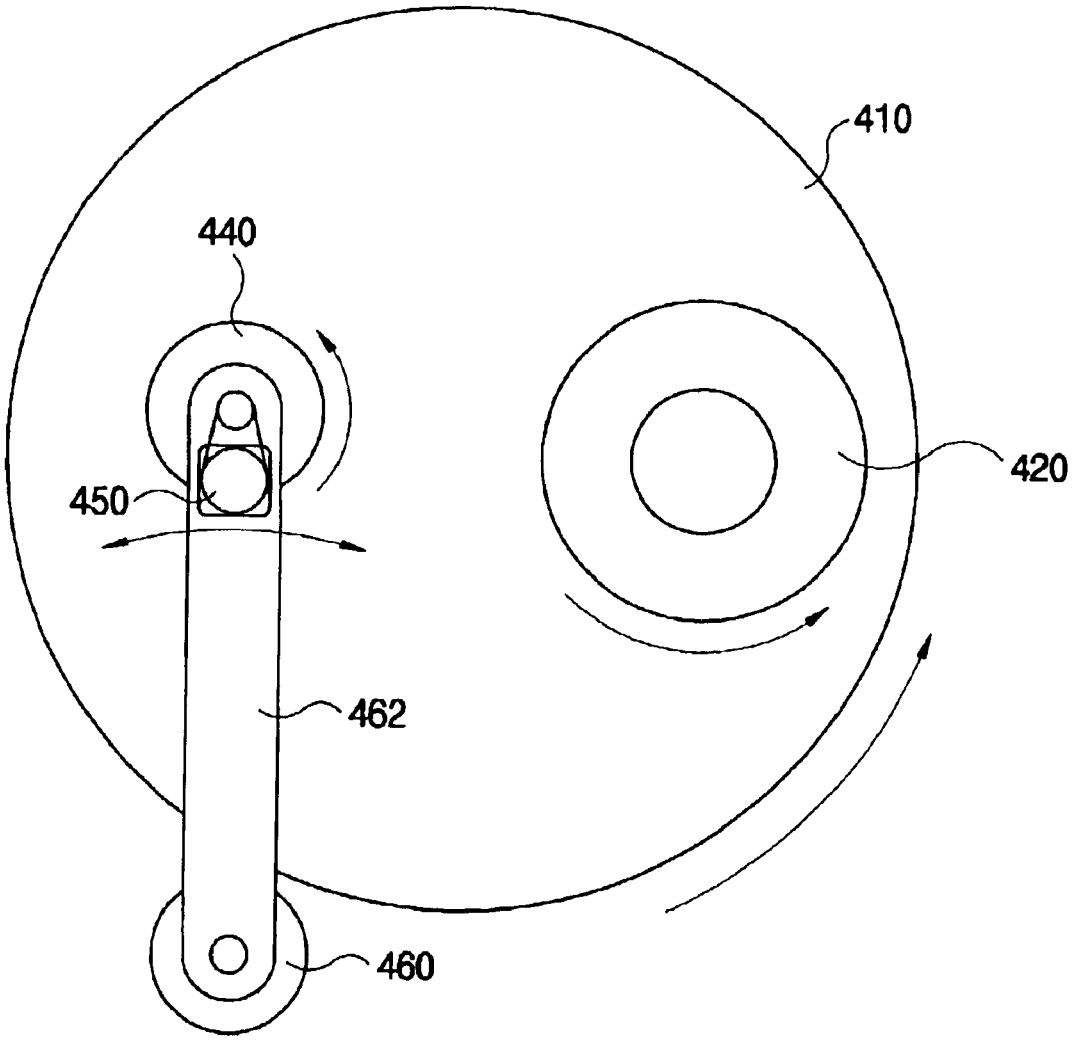
FIG. 7 is an enlarged plan view illustrating the CMP apparatus as shown in FIG. 6.

FIG. 6 is a schematic cross-sectional view illustrating a chemical-mechanical polishing (CMP) apparatus according to a third embodiment of the present invention, and FIG. 7 is an enlarged plan view illustrating the CMP apparatus in FIG. 6. Referring to FIGS. 6 and 7, the CMP apparatus 400 has a rotating table 412, a polishing head 420, a slurry supplying part 432, and a polishing pad conditioner 440.

The rotating table 412 includes a polishing pad 410 attached thereto for polishing a semiconductor substrate 900. The polishing head 420 holds the semiconductor substrate 900 so that the surface of the semiconductor substrate 900 to be polished is opposite to the polishing pad 410. The polishing head 420 moves semiconductor substrate 900 so that the surface thereof to be polished comes into contact with the polishing pad 410 during polishing of the semiconductor substrate 900. Additionally, the polishing head 420 rotates the semiconductor substrate 900. The slurry supplying part 432 supplies a slurry 430 between the semiconductor substrate 900 and the polishing pad 410 during polishing of the semiconductor substrate 900. The polishing pad conditioner 440 improves the surface condition of the polishing pad 410.

The rotating table 412 has a disc shape, and the polishing pad 410 is attached on the upper face of the rotating table 412. A plurality of micro holes are formed on the surface of the polishing pad 410, and also a plurality of grooves are formed on the surface of the polishing pad 410 in order to smooth the drafting of the slurry.

The polishing pad conditioner 440 has a disc shape, and makes contact with the polishing pad 410. The polishing pad conditioner 440 includes a conditioning plate 442, a holder 444, and a plurality of bolts. The conditioning plate 442 has a disc shape, and the holder 444 also has a disc shape. The holder 444 holds the conditioning plate 442, and the bolts connect the conditioning plate 442 to the holder 444. Diamond particles are attached to the bottom face of the conditioning plate 442 making contact with the polishing pad 410, so as to improve the surface condition of the polishing pad 410.

A first recess is formed on the upper face of the conditioning plate 442 in order to reduce the weight of the polishing pad conditioner 440. In addition, a second recess corresponding to the first recess is formed on the bottom face of the holder 444 for reducing the weight of the polishing pad conditioner 440. A first filling member 442*a* having a specific gravity lower than that of the conditioning plate 442 is disposed to fill up the first recess, and a second filling member 444*a* having a specific gravity lower than that of the holder 444 is formed to fill up the second recess. For example, in the case that the conditioning plate 442 and the holder 444 are composed of metal, the first and the second filling members 442*a* and 444*a* can include synthetic resin. Hence, the weight of the polishing pad conditioner 440 can be reduced while the slurry 430 provided onto the polishing pad 410 is prevented from flowing into the first recess of the conditioning plate 442 and the second recess of the holder 444.

The holder 444 of the polishing pad conditioner 440 is coupled to rotation shafts 446*a* and 446*b* that transfer a rotation force. The first rotation shaft 446*a* is connected to the central portion of the upper face of the holder 444, and the second rotation shaft 446*b* is coupled to a first driving part 450 providing the rotation force, as shown in FIG. 7.

An air bladder 448 is installed between the first rotation shaft 446*a* and the second rotation shaft 446*b*. A space for receiving air is provided in the air bladder 448. The inner pressure of the air bladder 448 can be controlled so that the height of the polishing pad conditioner 440 can be adjusted. That is, the volume of the air bladder 448 is varied with the inner pressure thereof, and the height of the polishing pad conditioner 440 coupled to the first rotation shaft 446*a* is controlled in accordance with the volume variation of the air bladder 448.

The weight of the polishing pad conditioner 440 is reduced according to the volumes of the first recess of the conditioning plate 442 and the second recess of the holder 444, and the specific gravities of the first and the second filling members 442*a* and 444*a*. The volume of the air bladder 448 and thus the height of the polishing pad conditioner 440 can be precisely controlled because of the weight reduction of the polishing pad conditioner 440. Also, the durability and service life of the air bladder 448 can be improved because of the weight reduction of the polishing pad conditioner 440.

The first driving part 450 includes a first motor for rotating the polishing pad conditioner 440. The first driving part 450 can be coupled to the second rotation shaft 446*b* with a power transmission member, such as a timing belt. In addition, a second driving part 460 is disposed adjacent to the polishing pad 410. The second driving part 460 is connected to the polishing pad conditioner 440 across the polishing pad 410 such that the polishing pad conditioner 440 is swung in the horizontal direction by the second driving part 460. The second driving part 460 has a second motor for swinging the polishing pad conditioner 440. The second driving part 460 is connected to the second rotation shaft 446*b* with an arm 462.

The air bladder 448 contacts the polishing pad conditioner 440 with the polishing pad 410. Additionally, the first driving part 450 rotates the polishing pad conditioner 440, and the second driving part 460 swings the polishing pad conditioner 440 using the arm 462 extended over the polishing pad 410.

According to the present invention, the weight of the polishing pad conditioner is reduced by means of the first recess of the conditioning plate and the second recess of the holder. Hence, the volume of the air bladder and the height of the polishing pad conditioner can be exactly controlled in order to contact the polishing pad conditioner with the polishing pad. Also, the life times of the polishing pad and the air bladder can be improved, and the polishing efficiency of the semiconductor substrate can be enhanced because of the precise control of the height of the polishing pad conditioner. Additionally, the operation rate of the CMP apparatus can be increased.

Having described the preferred embodiments of the present invention, it is noted that modifications and variations can be made by persons skilled in the art in light of the above teachings. It is therefore to be understood that changes may be made to the disclosed embodiments of the present invention within the scope and the spirit of the invention outlined by the appended claims.

What is claimed is:

1. A polishing pad conditioner comprising:

a conditioning plate contactable with a polishing pad for improving a surface condition of the polishing pad for polishing a surface of a substrate, the conditioning plate having a first face and a second face, wherein a first recess is formed on the second face and the first face is contactable with the polishing pad;

a holder coupled to the second face of the conditioning plate, the holder having a third face, wherein a second recess is formed on the third face, said second recess confronting said first recess;

a combining element that secures the conditioning plate to the holder; and a sealing member disposed between said second and third faces at outer peripheral portions thereof and providing a seal between said second and third faces around the first and second recesses.

2. A polishing pad conditioner comprising:

a conditioning plate for improving a surface condition of a polishing pad for polishing a surface of a substrate, the conditioning plate having a first face contactable with the polishing pad and a second face corresponding to the first face, wherein a first recess is formed on the second face;

a holder coupled to the second face of the conditioning plate, the holder having a third face making contact with the second face, wherein a second recess corresponding to the first recess is formed on the third face;

a first filling member filling up the first recess, the first filling member including a first material having a specific gravity smaller than a specific gravity of the conditioning plate;

a second filling member filling up the second recess, the second filling member including a second material having a specific gravity smaller than a specific gravity of the holder; and a combining element that secures the conditioning plate with the holder.

3. The polishing pad conditioner of claim 2, wherein the conditioning plate includes a same material as the holder.

4. The polishing pad conditioner of claim 2, wherein the first and second filling members include a synthetic resin.

5. The polishing pad conditioner of claim 2, wherein the first recess is formed at a central portion of the second face, and the second recess is formed at a central portion of the third face.

6. The polishing pad conditioner of claim 2, wherein both the conditioning plate and the holder have a disc shape, and both the first and second recesses have a circular shape.

7. The polishing pad conditioner of claim 2, wherein the combining element includes a bolt.

8. The polishing pad conditioner of claim 2, further comprising a sealing member disposed at edge portions of the first and second faces between the conditioning plate and the holder.

9. A chemical-mechanical polishing apparatus comprising:

a rotating table having a pad that polishes a surface of a substrate;

a polishing head that holds the substrate so that the surface of the substrate to be polished is opposite to the pad, that contacts the surface of the substrate with the pad during polishing of the substrate, and that rotates the substrate;

a slurry supplying part that supplies a slurry between the substrate and the pad during polishing of the substrate; and a polishing pad conditioner having a conditioning plate for improving a surface condition of the pad, the conditioning plate having a one-piece conditioning disc contactable with a polishing pad for improving a surface condition of the polishing pad for polishing a surface of a substrate, the conditioning disc having first and second oppositely disposed surfaces, and an abrasive fixed at said first surface for use in conditioning said pad.

a holder having a third surface disposed face-to-face with said second surface of said conditioning disc.

wherein said holder and said conditioning disc define a sealed cavity therebetween at the interface of said second and third surfaces, and a mechanical fastener by which said one-piece conditioning disc is immovably fixed to said holder.

10. The chemical-mechanical polishing apparatus of claim 9, wherein said conditioning disc has a recess in said second surface thereof, said holder has a recess in said third surface, said recesses constituting paid cavity, and further comprising: a first filling member filling up the first recess, the first filling member including a first material having a specific gravity smaller than a specific gravity of the conditioning disc; and a second filling member filling up the second recess, the second filling member including a second material having a specific gravity smaller than a specific gravity of the holder.

11. The chemical-mechanical polishing apparatus of claim 10, wherein the first and second filling members include a synthetic resin.

12. The chemical-mechanical polishing apparatus of claim 9, and further comprising an air bladder that moves the conditioning disc and the holder so that the first surface makes contact with the pad.

13. The chemical-mechanical polishing apparatus of claim 9, wherein said cavity is completely empty.

14. A polishing pad conditioner comprising:

a one-piece conditioning disc contactable with a polishing pad for improving a surface condition of the polishing pad for polishing a surface of a substrate, the conditioning disc having first and second oppositely disposed surfaces, and an abrasive fixed at said first surface for use in conditioning the polishing pad;

a holder having a third surface disposed face-to-face with said second surface of said conditioning disc, wherein said holder and said conditioning disc define a sealed cavity therebetween at the interface of said second and third surfaces; and a mechanical fastener by which said one-piece conditioning disc is immovably fixed to said holder.

15. The polishing pad conditioner of claim 14, wherein said conditioning disc has a recess in said second surface thereof, said recess constituting said cavity.

16. The polishing pad conditioner of claim 15, wherein said holder has a recess in said third surface, said recesses together forming said cavity.

17. The polishing pad conditioner of claim 16, wherein said recess in said second surface of the conditioning disc is filled with a material having a specific gravity smaller than the specific gravity of the conditioning disc, and said recess in said third surface of the holder is filled with a material having a specific gravity smaller than the specific gravity of the holder.

18. The polishing pad conditioner of claim 15, wherein said recess in said second surface of the conditioning disc is filled with a first material having a specific gravity smaller than the specific gravity of the conditioning disc.

19. The polishing pad conditioner of claim 14, wherein said holder has a recess in said third surface, said recess constituting said cavity.

20. The polishing pad conditioner of claim 19, wherein said recess in said third surface of the holder is filled with a material having a specific gravity smaller than the specific gravity of the holder.

21. The polishing pad conditioner of claim 14, wherein slid cavity is completely empty.

22. The polishing pad conditioner of claim 14, wherein said mechanical fastener comprises a bolt.

23. The polishing pad conditioner of claim 14, wherein said abrasive comprises diamond particles.

24. A polishing pad conditioner comprising:

a conditioning disc contactable with a polishing pad for improving a surface condition of the polishing pad for polishing a surface of a substrate, the conditioning disc having first and second oppositely disposed surfaces, and an abrasive fixed at said first surface for use in conditioning the polishing pad;

a holder having a third surface disposed face-to-face with said second surface of said conditioning disc, wherein said holder and said conditioning disc define a sealed cavity therebetween at the interface of said second and third surfaces, said being completely empty; and a coupling element that secures said conditioning disc to said holder.

25. The polishing pad conditioner of claim 24, and further comprising a sealing member disposed between said second and third surfaces at oute peripheral portions thereof and providing a seal between said second and third surfaces around said cavity.

* * * * *